United States Patent [19]

Pecorari

[11] 3,968,736

[45] July 13, 1976

[54] RADIAL FLUID-PRESSURE APPARATUS

[76] Inventor: Felice Pecorari, Via Zanoni, 62, Modena, Italy

[22] Filed: May 20, 1974

[21] Appl. No.: 471,781

[30] Foreign Application Priority Data

May 24, 1973 Italy ..... 40048/73

[52] U.S. Cl. ..... 92/165 R; 92/72; 92/148; 92/167; 417/437

[51] Int. Cl.[2] ..... F16J 15/18

[58] Field of Search ..... 417/437, 273, 464–465; 92/165 R, 118–119, 72, 167

[56] References Cited

UNITED STATES PATENTS

| | | | |
|---|---|---|---|
| 2,844,103 | 7/1958 | Bennett | 92/165 R |
| 3,053,594 | 9/1962 | Williamson | 92/165 R |
| 3,577,830 | 5/1971 | Ortelli | 92/72 |
| 3,695,146 | 10/1972 | Orshansky | 91/488 |

FOREIGN PATENTS OR APPLICATIONS

| | | | |
|---|---|---|---|
| 1,653,368 | 2/1970 | Germany | 49/491 |

*Primary Examiner*—Carlton R. Croyle
*Assistant Examiner*—O. T. Sessions
*Attorney, Agent, or Firm*—Steinberg & Blake

[57] ABSTRACT

A radial type of fluid-pressure apparatus, such as a pump or motor, wherein a crankshaft is supported for rotation about its axis and has a crankpin radially spaced from its axis and connected with the inner end region of a piston which extends outwardly away from the crankshaft axis and which has an outer end region extending into a chamber of an outer housing structure which surrounds the crankshaft axis. This chamber communicates with a fluid passage. An inner circular housing structure is surrounded by the outer housing structure and surrounds the crankshaft while being formed with an opening through which the piston extends, this inner housing structure having a seat at its opening which surrounds the piston. The latter seat forms part of a sphere. The piston extends slidably through a sleeve which has an outer surface also forming part of the latter sphere and seated on this seat. A spring engages the sleeve to urge the latter into engagement with the seat for maintaining a fluid-tight contact between the sleeve and the seat while at the same time the sleeve can rock with respect to the seat during transmission of motion between the piston and the crankshaft.

9 Claims, 2 Drawing Figures

FIG. 1
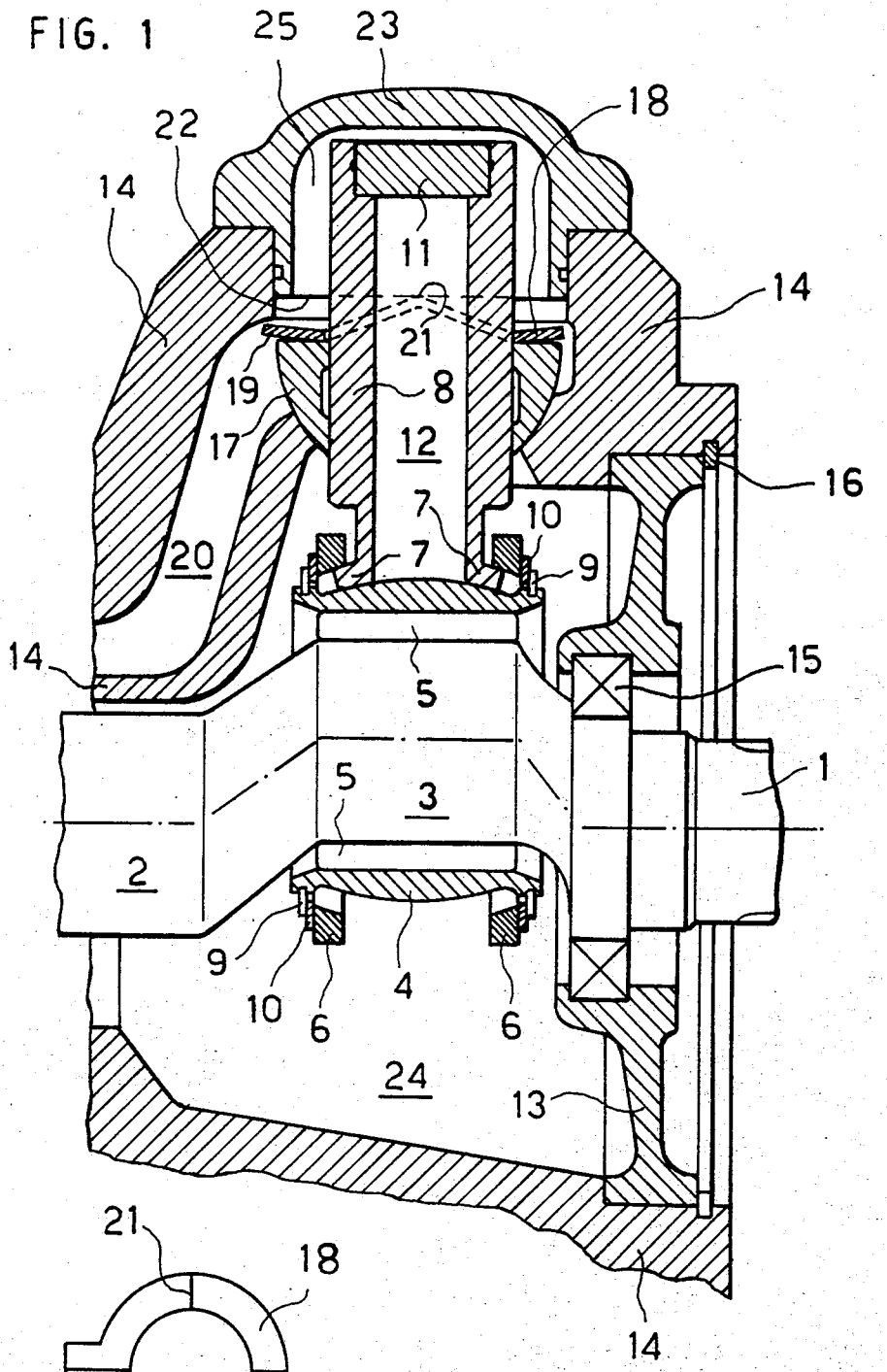
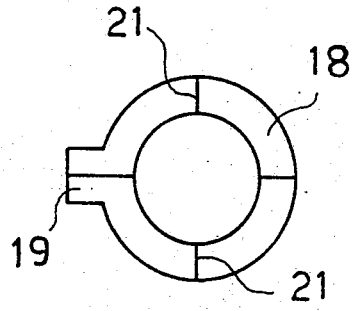
FIG. 2

RADIAL FLUID-PRESSURE APPARATUS

BACKGROUND OF THE INVENTION

The present invention relates to fluid-pressure apparatus such as a pump or motor.

In particular, the present invention relates to a radial type of fluid-pressure apparatus wherein pistons are circumferentially distributed about the axis of a crankshaft projecting substantially radially therefrom in the manner of spokes of a wheel.

The present invention is particularly applicable to hydraulic pumps or motors utilizing a liquid such as oil.

Although the following description relates to a radial type of hydraulic apparatus wherein the pistons have a star arrangement, the invention is also applicable to an in line arrangement of the pistons.

In conventional fluid-pressure apparatus of the above type the circumferentially distributed pistons are connected to a crankpin of the crankshaft by way of a spherical coupling structure. Each piston is tubular and extends into the interior of a sleeve which has an inner surface slidably engaging the outer surface of the piston. The sleeves are coupled by way of ball joints to the housing and the oil under pressure which circulates therein flows into the interior of the sleeves as well as into the interior of the pistons which are formed with axial bores for this purpose.

Conventional structure of the above type suffers from a number of drawbacks. Thus such conventional structures have undesirably high manufacturing costs particularly because of the precise fit required between the pistons and the sleeves in which they slide as well as because of the ball joints which are required to connect the outer ends of the sleeves to the housing. These conventional structures result in a high degree of friction during operation with a resulting undesirable reduction in efficiency. When operating at pressures on the order of 200–250 atmospheres, there is a considerable deformation of the components as well as an undesirably high degree of wear, leakage of oil, and seizing is not uncommon. In addition, because of the large mass of the pistons and sleeves and the relatively great distance between the crankpin and the part of the casing to which the outer ends of the sleeves are connected by the ball joints, it is not possible to achieve speeds greater than 400–500 r.p.m.

SUMMARY OF THE INVENTION

It is accordingly a primary object of the present invention to provide a radial type of fluid-pressure apparatus which will avoid the above drawbacks.

In particular, it is an object of the present invention to provide a radial fluid-pressure apparatus which will have a far smaller manufacturing cost than comparable conventional fluid-pressure apparatus.

Also it is an object of the present invention to provide a structure of the above type where the components are connected to each other in such a way that efficiency is not reduced while friction and wear of the components is maintained at a desirable relatively low level.

In addition it is an object of the present invention to provide for a fluid-pressure apparatus components which are of a relatively light weight while capable of moving at high speeds without being subjected to undesirable deformation.

In addition it is an object of the present invention to provide a fluid-pressure apparatus of the above type which can operate effectively at pressures on the order of 400–500 atmospheres and higher, while being capable of achieving speeds of rotation practically double those obtained with conventional motors or pumps without any damaging deformation as a result of knocking or bending, while reliably eliminating the possibility of seizure of the components.

Thus, it is an object of the present invention to reduce to a minimum the extent to which surfaces must be maintained in slidable engagement with each other while also reducing the size of the components and the extent to which precision machining is required.

In accordance with the present invention the above objects are achieved at least in part by surrounding a piston over only part of its length, between its ends, with a sleeve through which the piston slides, this sleeve having an exterior surface forming part of a sphere and seated on a seat which also forms part of the same sphere and which forms part of the housing, a suitable spring maintaining this sleeve in engagement with the above seat so that the sleeve can rock with respect to the seat while remaining in fluid-tight sliding engagement therewith. This seat forms part of an inner housing means which surrounds a crankshaft which has a crankpin connected by a spherical type of coupling structure to an inner end region of the piston. An outer housing means surrounds the inner housing means and defines an inner chamber which receives the outer end region of the piston, this chamber communicating with a fluid passage.

BRIEF DESCRIPTION OF DRAWINGS

The invention is illustrated by way of example in the accompanying drawings which form part of this application and in which:

FIG. 1 is a fragmentary sectional elevation of a fluid-pressure apparatus according to the invention, the section of FIG. 1 being taken in a plane which contains the axis of the crankshaft with FIG. 1 showing only one piston, whose axis is also situated in the plane of FIG. 1, for the sake of clarity in illustrating the invention; and FIG. 2 is a plan view of a spring means which forms part of the structure of FIG. 1.

DESCRIPTION OF PREFERRED EMBODIMENTS

The fluid-pressure apparatus which forms the pump or motor illustrated in FIG. 1 includes a rotary crankshaft 2 having an outer end 1 from which power is taken when the apparatus is utilized as a motor or engine and which is driven in any suitable way, for rotating the crankshaft 2 about its axis, when the apparatus operates as a pump. The crankshaft 2 has a crankpin 3 surrounded by a bushing 4 having an inner cylindrical surface and an outer surface forming part of a sphere. A suitable roller bearing structure 5 is situated between the crankpin 3 and the inner cylindrical surface of the bushing 4 so that the crankpin 3 can rotate freely within the bushing 4.

The inner end region 7 of a hollow piston 8 is operatively connected with the crankpin 3 through a connecting means part of which is formed by the bushing 4 and the roller bearing 5, so that motion can be transmitted between the piston 8 and the crankshaft 2. It will be understood that although only one piston 8 is illustrated, a plurality of these pistons are provided. For example five pistons 8 are circumferentially distributed around the bushing 4 with their axes extending substantially radially with respect to the crankpin 3, but only one piston 8 is illustrated for the sake of clarity. Thus the several pistons have a star arrangement typical of radial pumps or motors where the pistons have an arrangement similar to the spokes of a wheel.

The connecting means which includes the bushing 4 and the ball bearing 5 also includes a pair of rings 6 respectively situated in planes normal to the axis of the crankshaft 2 and engaging the outer surface of an outwardly directed flange situated at the inner end region 7 of each piston 8. The rings 6 have inner circumferential surfaces which form part of a sphere and the outer surfaces of the flanges at the inner end regions 7 also form part of the same sphere while the inner end surfaces of the pistons form part of a sphere of the same magnitude as the sphere of which the outer surface of the bushing 4 forms a part. Of course the sphere of which the outer surface of the bushing 4 forms a part has a center which coincides with the center of the sphere which is formed in part by the inner surfaces of the rings 6 and the outer surfaces of the flanges at the inner end regions 7 of the pistons 8. A pair of elastic retaining rings 9 which are respectively parallel to the rings 6 are received in outer circumferential grooves formed in the bushing 4. These retaining rings 9 respectively engage a pair of circular cup springs 10 which in turn press against the rings 6 so as to urge the latter axially toward each other in the manner apparent from FIG. 1. In this way the rings 6 are pressed against the flanges at the inner end regions 7 of the pistons 8 and serve to maintain the inner end regions 7 in tight contact with the exterior convex surface of the bushing 4.

Each of the pistons 8 is formed with an axial bore 12 passing completely therethrough so as to maintain the weight of the pistons at a minimum. In order to prevent the oil from entering into the hollow interiors 12 of the pistons 8, each piston carries a closure means 11 at its outer end region. This closure means 11 can take the form of a simple plug fixed to the outer end region of each piston 8 in the manner shown in FIG. 1.

A support means is provided to support the crankshaft 2 for rotation about its axis. This support means includes an annular cover 13 which surrounds the crankshaft 2 at the region of its outer end 1 while closing off the hollow interior 24 of the housing 14 from the outer atmosphere. An elastic snap ring 16 is received in a groove of the housing 14 for retaining the cover 13 in the position illustrated in FIG. 1. A bearing 15 is situated between the cover 13 and the crankshaft 2 so as to form part of the support means which supports the crankshaft 2 for rotation about its axis. The supporting structure for the part of the crankshaft 2 which extends toward the left beyond the part illustrated in FIG. 1 is not illustrated.

In accordance with one of the features of the invention each of the pistons 8 extends slidably and fluid-tightly through a sleeve 17 which has an inner cylindrical surface slidably engaging the exterior cylindrical surface of each piston 8 along a relatively small fraction of the total length thereof. The sleeve 17 serves to guide the piston 8 for reciprocation along its axis. Part of the housing 14 is in the form of an inner housing means which directly surrounds the crankshaft 2 so as to form part of the hollow interior 24 of the housing 14, and this inner housing means is formed for each piston 8 with an opening through which the piston extends, and this opening of the inner housing means forms part of a sphere serving as a seat for the sleeve 17. For this purpose the exterior surface of the sleeve 17 also forms part of the same sphere as the seat which receives the sleeve 17 as illustrated in FIG. 1. Thus it will be seen that the sphere of which the exterior surface of the sleeve 17 and the seat therefor forms a part has its center situated outwardly beyond the inner housing means which is formed with the seat engaged by the sleeve 17. With this construction the sleeve 17 is capable of rocking at its seat during the reciprocation of the piston 8 while motion is transmitted between the piston and the crankshaft.

The housing 14 includes an outer housing means which circumferentially surrounds the inner housing means provided with the seats for the sleeves 17 as described above. The outer housing means is formed for each piston 8 with an opening through which the piston extends as illustrated, and this opening is fluid-tightly closed by a hollow cap structure 23 which forms part of the outer housing means of the housing 14 and which defines for each piston a chamber 25 which receives the outer end region of each piston 8. It will be seen that the chamber 25 is defined by an inner cylindrical surface of the cap 23 which surrounds and extends longitudinally along a substantial part of the piston 8 in the region of its outer end while being located relatively close to the piston 8 and at the same time having with respect thereto a clearance sufficient to permit the piston 8 to rock within the cylindrical chamber 25. In addition, this chamber 25 is defined by an outer wall portion of the outer housing means, formed by the outer end wall region of the cap 23, and it will be seen that the piston 8 approaches closely to this outer wall portion which defines part of the chamber 25. The chamber 25 communicates with a fluid passage 20 which in turn communicates with a suitable unillustrated distributor structure. Thus a fluid such as oil under pressure can flow along the passage 20 either to or from the chamber 25.

Each of the hollow caps 23 has an inner end surface 22 directed toward an outer end surface of each sleeve 17. The outer end surface of the sleeve 17 is flat and surrounds the piston 8 while being situated in a plane normal to the axis of the piston 8 so that each sleeve 17 forms a section of a sphere such as, for example, part of a hemisphere. Between the outer end surface of each sleeve 17 and the inner end surface 22 of each cap 23 is a spring means 18 which serves to urge the sleeve 17 against its seat so that in this way a fluid-tight slidable engagement of each sleeve 17 on its seat is assured. The spring means 18 takes the form of a ring which surrounds the piston 8 and is situated between and in engagement with the outer flat surface of the sleeve 17 and the inner surface 22 of the cap 23. Each cap 23 can be fixed to the remainder of the outer housing means by way of suitable screws, for example.

The ring 18 which forms the spring means has at its outer periphery a radially extending projection 19 which is received in the outer end of the passage 20 so that this projection 19 cooperates with the outer end of the passage 20 to prevent rotation of the ring 18 around the axis of the piston 8. The ring 18 is formed with a pair of diametrically opposed portions 21 extending outwardly from the sleeve 17 toward and into engagement with the surface 22 so as to press against the latter surface, while symmetrically situated between the portions 21 the ring 18 has a pair of additional diametrically opposed portions which extend inwardly toward and press against the outer end surface of the sleeve 17.

Thus in the illustrated example the ring 18 takes the form of a strip of springy sheet material which is provided with a pair of outwardly directed crests pressing against the surface 22. Situated midway between the outwardly directed crests 21, at an angle of 90° therefrom, are a second pair of diametrically opposed crests which are directed inwardly toward and engage the outer ends of the sleeve 17. Of course, when the spring ring 18 is in its unstressed condition the outwardly directed crests 21 and the second pair of inwardly directed crests will be spaced from each other along the axis of the ring 18 by a distance greater than the distance between the surface 22 and the outer end surface of the sleeve 17. As a result when the parts are assembled in the manner illustrated in FIG. 1 the spring means 18 is compressed between the surface 22 and the sleeve 17 so as to press the latter against its seat. In this way the required cooperation between the sleeve 17 and its seat is assured while at the same time an oil seal is reliably maintained. Of course, all of the inner end regions of the several pistons will communicate with the inner housing space 24 which accommodates the crankshaft 2 as well as the connecting means which connects the inner end regions 7 of the pistons to the crankshaft 2.

Assuming that the above-described structure of the invention is to operate as a motor, then oil under pressure will be supplied by the unillustrated distributor in a suitably timed relationship through the passage 20 to the chamber 25 to act on the outer end region of the piston 8 so as to push the piston 8 inwardly toward the axis of the crankshaft 2, thus imparting rotation thereto by way of the crankpin 3. The piston 8 slides along its axis with an effective oil seal being maintained between the exterior surface of the piston 8 and the inner cylindrical surface of the sleeve 17. At the same time the sleeve 17 is reliably maintained on its seat in the manner described above, particularly by the spring means 18. The same operations will of course take place cyclically in suitably timed relation at the other pistons which will be supplied with oil under pressure from the unillustrated distributor through additional passages which are not illustrated. It is to be noted that the oil will not enter the hollow interior 12 of each piston 8.

Of course, it is possible to vary certain constructional details, dimensions, and materials of the structure of the invention without going beyond the scope thereof and of course certain parts can be replaced by other equivalent parts.

What is claimed is:

1. In a radial type of fluid-pressure apparatus, rotary crankshaft means and support means supporting said rotary crankshaft means for rotation about its axis, said rotary crankshaft means having a crankpin spaced radially from its axis of rotation, a piston extending outwardly away from said crankpin and having an inner end region adjacent said crankpin, connecting means connecting said inner end region of said piston to said crankpin for transmitting motion between said piston and crankpin, outer housing means surrounding said axis and having an outer wall portion and an inner surface region defining a chamber into which an outer end region of said piston extends, fluid passage means communicating with said chamber, inner housing means surrounded by said outer housing means and situated between the latter and said axis with said inner housing means also surrounding said axis, said inner housing means being formed with a seat surrounding said piston and forming part of a sphere, a sleeve having an inner cylindrical surface surrounding and slidably engaging an exterior cylindrical surface of said piston with the latter extending through said sleeve, said sleeve having an outer surface forming part of a sphere of the same diameter as the sphere of which said seat forms a part and said sleeve being seated on said seat; and spring means urging said sleeve into engagement with said seat for maintaining a fluid-tight slidable engagement of said sleeve with said seat so that while said piston moves outwardly away from or inwardly toward said axis said sleeve can rock at said seat while remaining in fluid-tight engagement therewith, said piston approaching closely to said outer wall portion of said outer housing means during said movement of said piston outwardly away from said axis and said inner surface region of said outer housing means which defines said chamber surrounding and extending longitudinally along a substantial portion of said piston which extends from said outer end region therof and being located adjacent the latter substantial portion of said piston while at the same time being spaced therefrom by a distance sufficient to provide for free, unobstructed rocking of said piston in said chamber, said sphere of which said outer surface of said sleeve and said seat form a part having a center situated outwardly beyond said inner housing means and said sleeve having an outer end surface surrounding said piston and situated between said inner and outer housing means while being directed toward said outer housing means, said spring means engaging and being compressed between said outer end surface of said sleeve and said outer housing means for pressing said sleeve against said seat, said spring means including a ring of elastic sheet material surrounding said piston and having an inner surface part of which engages said outer end surface of said sleeve and an outer surface part of which engages said outer housing means, the latter having adjacent but spaced from said outer end surface of said sleeve an annular surface directed inwardly toward said outer end surface of said sleeve and being of the same diameter as said ring of elastic sheet material and engaged by said outer surface part thereof so that said ring of elastic sheet material is situated in its entirety adjacent said sleeve distant from said outer wall portion of said outer housing means.

2. The combination of claim 1 and wherein said piston has an elongated hollow interior and carries at its outer end region which is received in said chamber a closure means for preventing fluid from entering into the hollow interior of said piston.

3. The combination of claim 1 and wherein said sleeve has between said inner and outer housing means an outer flat end surface directed toward said outer housing means and engaged by said spring means to be urged thereby toward said seat, said flat end surface of said sleeve being situated in a plane which is substantially normal to the axis of said piston so that said sleeve forms a section of a sphere.

4. The combination of claim 1 and wherein said outer housing means includes a circular wall structure surrounding said axis and formed with an opening through which said piston extends, and said outer housing means further including a hollow cap fixed to said outer wall structure and closing said opening thereof, said cap having a hollow interior which receives the outer end region of said piston and which forms at least part of said chamber.

5. The combination of claim 4 and wherein said cap has an inner end surface directed toward said sleeve and surrounding said piston and forming said annular surface of said outer housing means which is engaged by said outer surface part of said ring of elastic sheet material.

6. In a radial type of fluid-pressure apparatus, rotary crankshaft means and support means supporting said rotary crankshaft means for rotation about its axis, said rotary crankshaft means having a crankpin spaced radially from its axis of rotation, a piston extending outwardly away from said crankpin and having an inner end region adjacent said crankpin, connecting means connecting said inner end region of said piston to said crankpin for transmitting motion between said piston and crankpin, outer housing means surrounding said axis and defining a chamber into which an outer end region of said piston extends, fluid passage means communicating with said chamber, inner housing means surrounded by said outer housing means and situated between the latter and said axis with said inner housing means also surrounding said axis, said inner housing means being formed with a seat surrounding said piston and forming part of a sphere, a sleeve having an inner cylindrical surface surrounding and slidably engaging an exterior cylindrical surface of said piston with the latter extending through said sleeve, said sleeve having an outer surface forming part of a sphere of the same diameter as the sphere of which said seat forms a part and said sleeve being seated on said seat, and spring means urging said sleeve into engagement with said seat for maintaining a fluid-tight slidable engagement of said sleeve with said seat so that while said piston moves outwardly away from or inwardly toward said axis said sleeve can rock at said seat while remaining in fluid-tight engagement therewith, said outer housing means including a circular wall structure surrounding said axis and formed with an opening through which said piston extends, and said outer housing means further including a hollow cap fixed to said outer wall structure and closing said opening thereof, said cap having a hollow interior which receives the outer end region of said piston and which forms at least part of said chamber, said cap having an inner end surface directed toward said sleeve and surrounding said piston while said sleeve has an outer end surface surrounding said piston and directed toward said inner end surface of said cap, and said spring means including a ring which surrounds said piston between said inner end surface of said cap and said outer end surface of said sleeve and compressed between said end surfaces for urging said sleeve toward said seat, said ring which forms said spring means having a first pair of diametrically opposed portions extending outwardly from said outer end surface of said sleeve into engagement with said inner end surface of said cap and symmetrically between said first pair of diametrically opposed portions a second pair of diametrically opposed portions extending from said first pair of diametrically opposed portions inwardly into pressing engagement with the outer end surface of said sleeve.

7. The combination of claim 6 and wherein said ring has at least one substantially radial projection at its outer periphery received in a part of said outer housing means to prevent rotary movement of said ring around the axis of said piston.

8. The combination of claim 7 and wherein said spring means is in the form of a strip of springy sheet material.

9. The combination of claim 8 and wherein said springy strip of sheet material has a pair of diametrically opposed outwardly directed crests engaging said inner end surface of said cap and forming part of said first pair of diametrically opposed portions and symmetrically situated with respect to said outwardly directed crests a pair of inwardly directed crests engaging said outer end surface of said sleeve and forming part of said second pair of portions of said spring means.

* * * * *